US007226307B1

(12) United States Patent
Chen et al.

(10) Patent No.: US 7,226,307 B1
(45) Date of Patent: Jun. 5, 2007

(54) PLUG CONNECTOR

(75) Inventors: Shi-Jung Chen, Chung Ho (TW); Chun-Hsu Chen, Chung Ho (TW)

(73) Assignee: Jess-Link Products Co., Ltd., Taipei County (TW)

( * ) Notice: Subject to any disclaimer, the term of this patent is extended or adjusted under 35 U.S.C. 154(b) by 67 days.

(21) Appl. No.: 11/493,549

(22) Filed: Jul. 27, 2006

(51) Int. Cl.
*H01R 13/627* (2006.01)

(52) U.S. Cl. ..... 439/352; 439/357

(58) Field of Classification Search ..... 439/352–358, 439/610, 108, 378, 92, 95, 607, 906, 931, 439/372
See application file for complete search history.

(56) References Cited

U.S. PATENT DOCUMENTS 6,454,577 B1 * 9/2002 Yi ..... 439/108
6,692,289 B1 * 2/2004 Nemoto ..... 439/352
6,830,472 B1 * 12/2004 Wu ..... 439/358
6,860,749 B1 * 3/2005 Wu ..... 439/352
6,890,205 B1 * 5/2005 Wu ..... 439/358
7,083,459 B1 * 8/2006 Wu et al. ..... 439/354

* cited by examiner

*Primary Examiner*—Truc T. Nguyen
*Assistant Examiner*—Edwin A. Leon
(74) *Attorney, Agent, or Firm*—Rosenberg, Klein & Lee

(57) ABSTRACT

A plug connector for plugging with a mating connector includes a lower housing, an upper housing fixed on the lower housing, a disengaged member and a covering lid. The upper housing has a receiving cavity concaved from its top surface and a pivotal groove formed in the receiving cavity. The disengaged member has a main body, an elastic member disposed on the main body, a handle portion extending and inclining upwardly from the main body, and a hooking plate extending from the main body. The hooking plate is opposite to the handle portion and is exposed outside the upper housing. The main body forms a rod-shaped portion disposed movably in the pivotal groove. The hooking plate hooks elastically the mating connector. The covering lid is fixed on the upper housing and covers the receiving cavity. The elastic member is propped against a bottom surface of the covering lid.

10 Claims, 4 Drawing Sheets

PLUG CONNECTOR

BACKGROUND OF THE INVENTION

1. Field of the Invention

The present invention relates to a plug connector, and more particularly to a small size connector having an engagement mechanism for engaging with a mating connector or disengaging from the mating connector.

2. Description of Related Art

Because of the rapid development of technology, data transferring requirement is more and more huge and rapidly. High speed data transfer systems require electrical connectors in which the electrical impedance ca be controlled in order to maintain the required data transfer rate of the electrical system.

Electrical connector is usually composed of a plug connector and a mating connector. The requirements for electrical connectors are not only smaller size, but also stable engagement between both. Therefore, in this field there is an essential need for plug connectors of smaller size in a prerequisite condition, wherein a stable engagement is necessary for engaging with the mating connector.

Accordingly, the present invention aims to propose a small size plug connector having an engagement mechanism to engage firmly with a mating connector for fulfilling the aforementioned requirements.

SUMMARY OF THE INVENTION

It is therefore a main object of the invention to provide a plug connector, which has an engagement mechanism for engaging with a mating connector for fixing the plug connector firmly to the mating connector, and the user can unlatch the plug connector easily from the mating connector.

For achieving the aforesaid objects, the present invention provides a plug connector that is plugged with a mating connector and comprises a lower housing, a upper housing, a disengaged member, and a covering lid. The upper housing is fixed on the lower housing, and has a receiving cavity that is concaved from a top surface thereof and a pivotal groove that is formed in the receiving cavity. The disengaged member includes a main body disposed in the pivotal groove, an elastic member disposed on the main body, a handle portion extending upwardly from the main body in an inclined way, and a hooking plate extending from the main body opposite the handle portion. The main body is formed with a rod-shaped portion rotatably disposed in the pivotal groove. The hooking plate is exposed outside the upper housing to hook a top surface of the mating connector. The covering lid is fixed on the upper housing and covers the receiving cavity. The elastic member is propped against a bottom surface of the covering lid.

To make it easier for our examiner to understand the innovative features and technical content, we use a preferred embodiment together with the attached drawings for the detailed description of the invention, but it should be pointed out that the attached drawings are provided for reference and description but not for limiting the present invention.

BRIEF DESCRIPTION OF THE DRAWINGS

The invention will be better understood and objectives other than those set forth above will become apparent when consideration is given to the following detailed description thereof. Such description makes reference to the attached drawings, wherein.

DETAILED DESCRIPTION OF PREFERRED EMBODIMENTS

Figure 1:
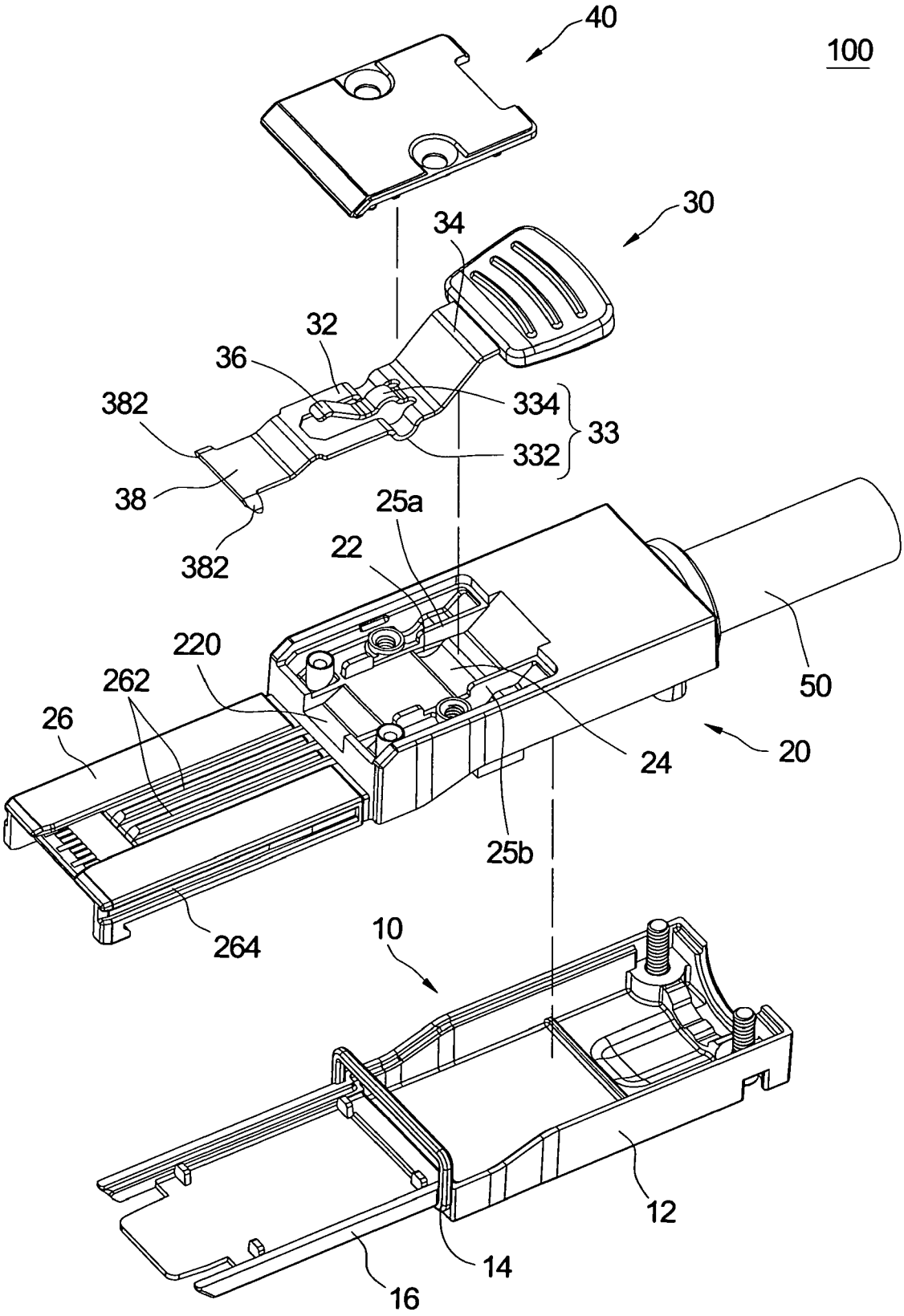
FIG. 1 is an explored perspective view of a plug connector of the present invention.
Figure 5:
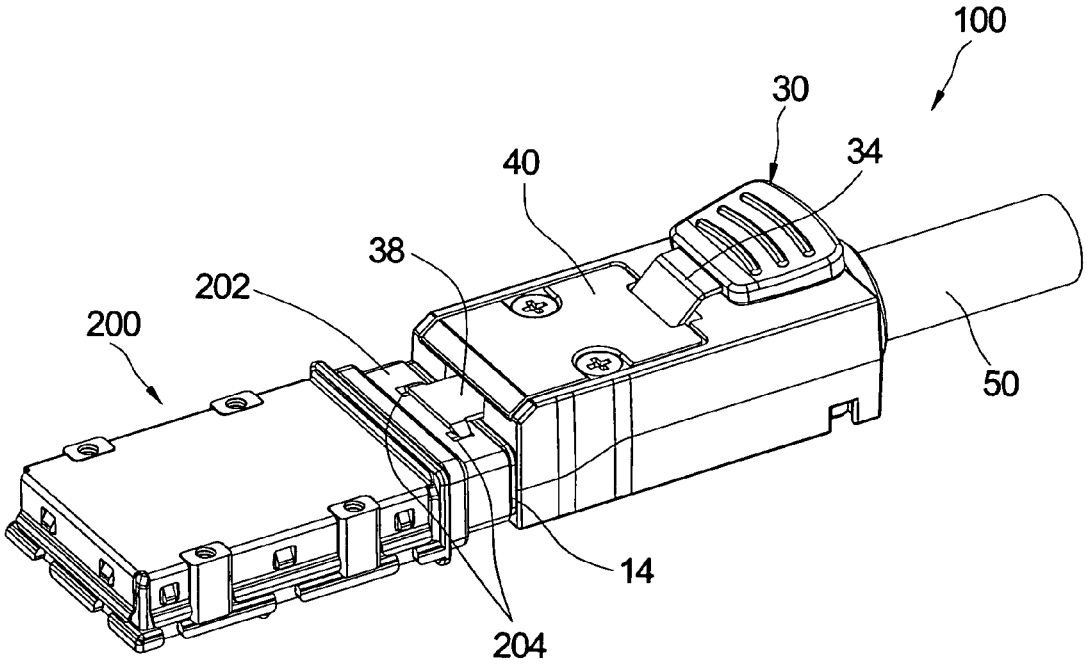
FIG. 5 is an assembled perspective view of a plug connector engaged with a mating connector of the present invention.

Reference is made to FIG. 1, which is an explored perspective view of a plug connector of the present invention. The present invention provides a plug connector 100, which could be engaged with a mating connector 200 as shown in FIG. 5. The plug connector 100 includes a lower housing 10, a upper housing 20, a disengaged member 30 and a covering lid 40. The plug connector 100 connects with a cable 50 at its rear end. The upper housing 20 combines with the lower housing 10 to form a housing. The housing receives a circuit board therein and the wires of the cable 50 are soldered on the circuit board. In this embodiment, the plug connector is a Small Form Factor Pluggable (SFP) connector.

The upper housing 20 has a receiving cavity 22 concaved from a top surface thereof, a pivotal groove 24 disposed in the receiving cavity 22, and a pair of positioning boards 25*a*, 25*b* protruded upwardly in the receiving cavity 22. The upper housing 20 extends a upper shielded portion 26 from its front edge. The lower housing 10 has a base portion 12 and a lower shielded portion 16 formed at a front end of the base portion 12. A washer 14 encircles the lower shielded portion 16. The upper shielded portion 26 forms a plurality of guiding portions 262, 264 for guiding the mating connector 200 accurately to plug with the plug connector 100.

The disengaged member 30 is made by a metal plate, and has a main body 32, a handle portion 34, an elastic member 36, and a hooking plate 38. The main body 32 is received in the receiving cavity 22 of the upper housing 20, and is disposed between the pair of positioning boards 25*a*, 25*b* for preventing it from moving laterally. The handle portion 34 extends backwardly and upwardly from the main body 32 in a inclined way. The elastic member 36 is disposed on the main body 32. The hooking plate 38 extends forwardly from the main body 32. The hooking plate 38 extends forwardly from the main body 32 opposite to the handle portion 34, and is exposed outside the upper housing 20. Reference is made to FIG. 5. The present invention utilizes the hooking plate 38 to elastically hook a top surface 202 of the mating connector 200, so that the plug connector 100 can engage with the mating connector 200 firmly.

Figure 2:
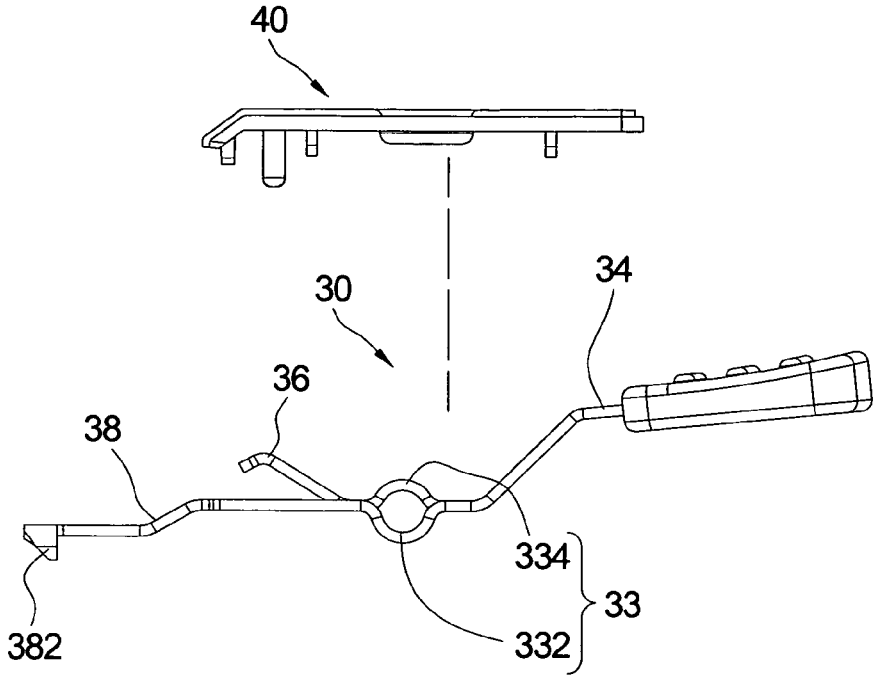
FIG. 2 is a side view of a disengaged member and a covering lid of the present invention.

Reference is made to FIGS. 1 and 2, wherein is a side view of a disengaged member and a covering lid of the present invention. The main body 32 of the disengaged member 30 forms a rod-shaped portion 33. The rod-shaped portion 33 is movably disposed in the pivotal groove 24. The disengaged member 30 therefore can rotate along the rod-shaped portion 33 in the receiving cavity 22 of the upper housing 20, in which the pivotal groove 24 can limit the displacement of the disengaged member 30 along a lengthwise direction.

The covering lid 40 is fixed to the upper housing 20 and covers the receiving cavity 22. The elastic member 36 has a top end that is propped against the bottom surface of the covering lid 40. In this embodiment, the covering lid 40 is screwed to the upper housing 20 via screws (not shown).

In this embodiment, it fully utilizes the characteristics of the disengaged member 30 being a metal plate, in which the rod-shaped portion 33 is formed by punching the main body 32 and is a cylinder-shaped shell. In more detail, the rod-shaped portion 33 is composed of a pair of lower-curve plates 332, and an upper-curve plate 334 formed between the pair of lower-curve plates 332. However, the rod-shaped portion of the present invention is not limited by this embodiment, for example the main body 32 can be formed as a semicircle groove, the rod-shaped portion can be a metal rod disposed in the semicircle groove of the main body 32.

Besides, the disengaged member 30 as a metal plate also is utilized fully to form integrally the elastic member 36 thereon. The elastic member 36 is extended form one end of the upper-curve plate 334, that is, the elastic member 36 and the upper-curve plate 334 are formed by punching a central portion of the disengaged member 30. The aforementioned structure results in the manufacturing of the disengaged member 30 being very easy and simple, that a disengaged member is just formed by punching. However, the elastic member of the present invention is not limited by this embodiment, for example the elastic member could be a spring disposed on the main body 32.

The plug connector 100 of the present invention can hook firmly with the mating connector 200. Reference is made to FIG. 5. The mating connector 200 forms a pair of engaging notch 204 on the top surface 202. The disengaged member 30 protrudes downwardly a pair of hooks 382 at the end of the hooking plate 38. The hooks 382 correspond to the pair of engaging notches 204. The washer 14 between the plug connector 10 and the mating connector 200 can provide elasticity for the mating connector 200 being able to engage with the hooking plate 38 more tightly. The washer 14 preferably is made of conductive rubber, so that it can provide the plug connector 100 grounding via the mating connector 200.

Figure 3:
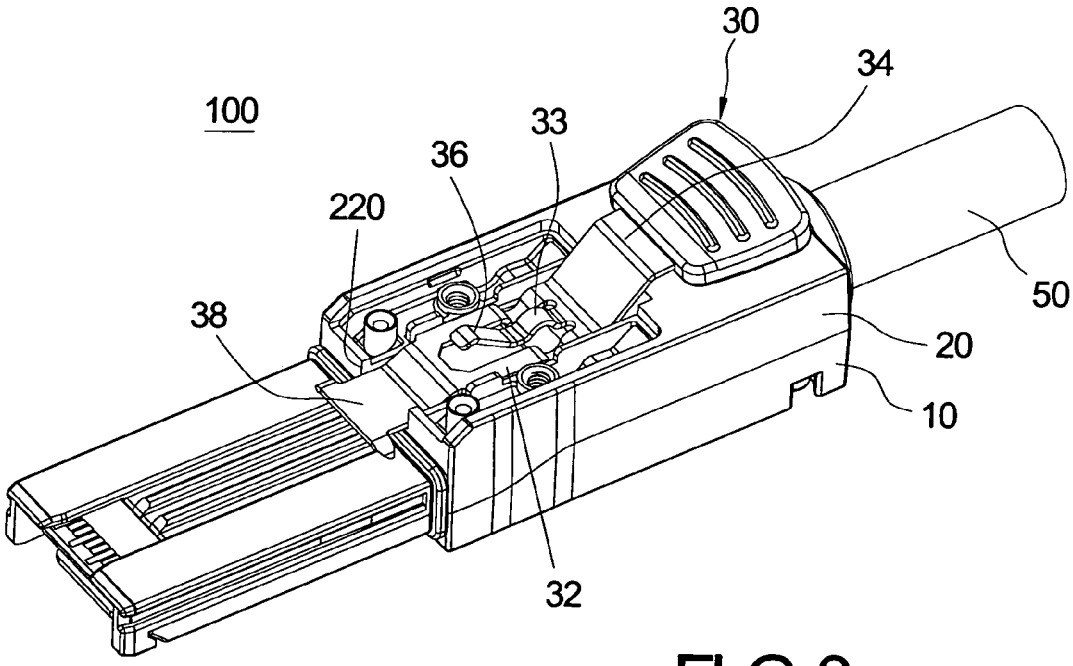
FIG. 3 is an assembled perspective view of plug connector without a covering lid of the present invention.
Figure 4:
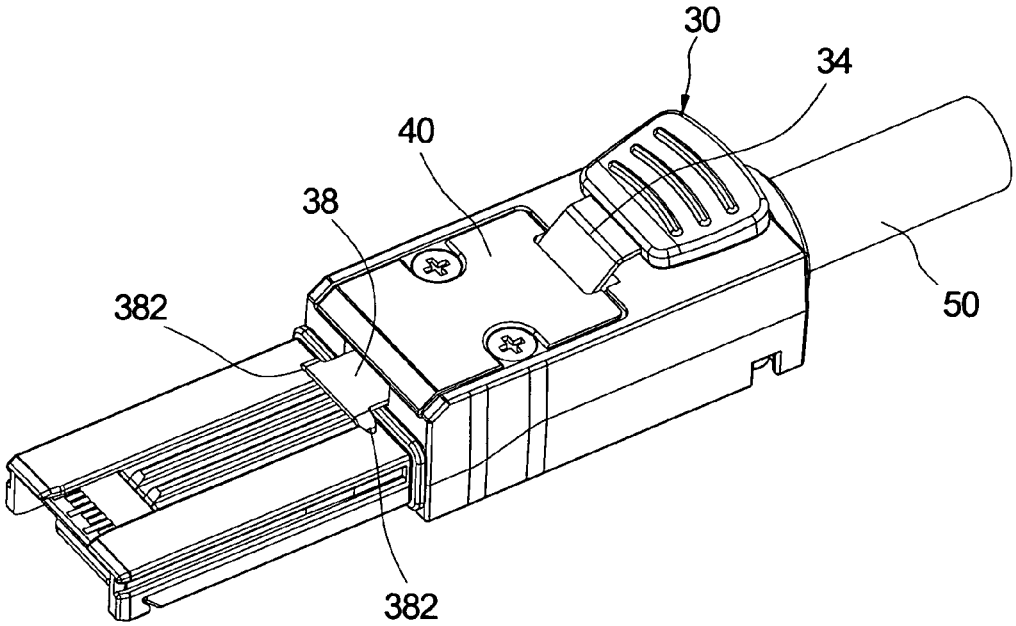
FIG. 4 is an assembled perspective view of plug connector with a covering lid of the present invention.

Reference is made to FIGS. 3 and 4, which are assembled perspective views of plug connector without/with a covering lid of the present invention. The upper housing 20 forms an erect opening 220 that is communicated with the receiving cavity 22. The hooking plate 38 of the disengaged member 30 is movably disposed in the erect opening 220.

Reference is made to FIG. 5, which is an assembled perspective view of a plug connector engaged with a mating connector of the present invention. When the user wants to take apart the plug connector 100 from the mating connector 200, the user only presses the handle portion 34 of the disengaged member 30. The disengaged member 30 will rotate along the rod-shaped portion 33, so that the hooking plate 38 raises upward to make the hooks 382 of the hooking plate 38 apart from the engaging notches 204 on the top surface 202 of the mating connector 200. Then the plug connector 100 can be apart from the mating connector 200.

Figure 6:
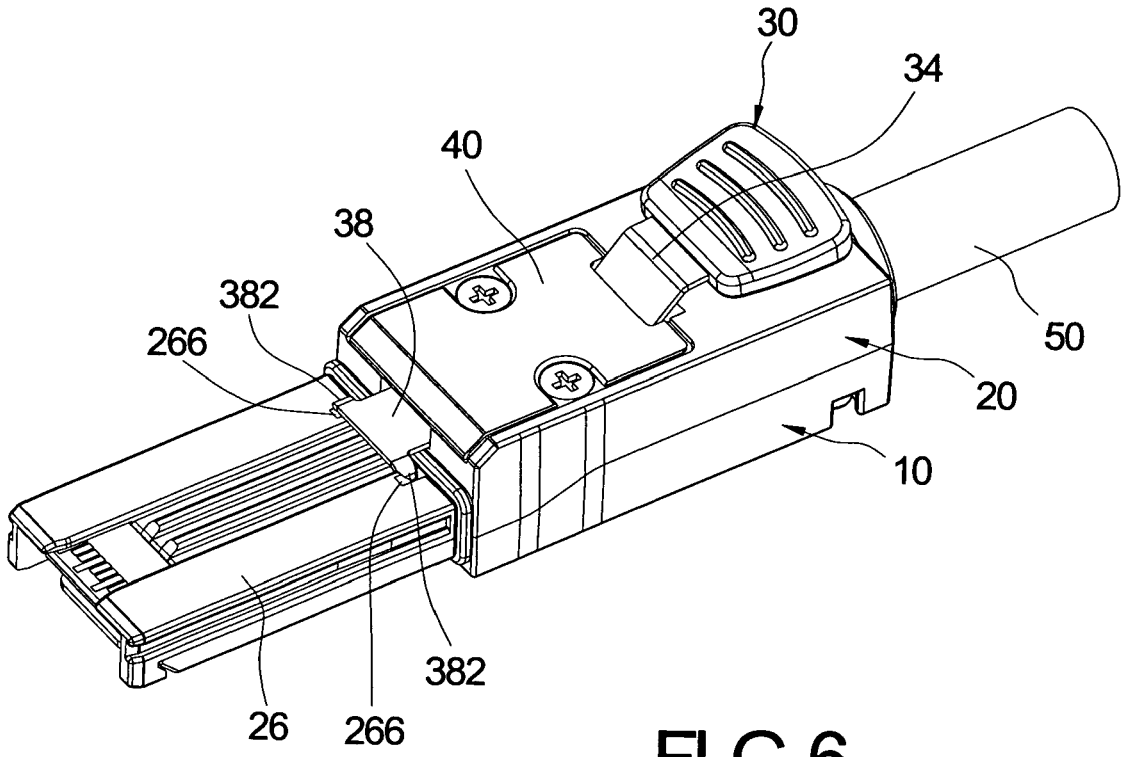
FIG. 6 is an assembled perspective view of a plug connector engaged with a mating connector of second embodiment of the present invention.

Reference is made to FIG. 6, which is an assembled perspective view of a plug connector of second embodiment of the present invention. In this embodiment, the upper shielded portion 26 of the upper housing 20 further includes two depression holes 266 corresponding to the hooks 382 of the hooking plate 38. The depression holes 266 are concaved from the surface of the upper shielded portion 26. The depression holes 266 can help the hooking plate 38 engage with the upper housing 20 more firmly after the hooks 382 pass through the engaging notches 204 of the mating connector 200, so that the mating connector 200 can plug to the plug connector more stably.

In summation of the description above, the invention includes the following advantages.

1. The present invention utilizes the receiving cavity formed in the upper housing for receiving an engagement mechanism to engage firmly with the mating connector. It utilizes the space of the plug connector 100 well.

2. The plug connector 100 of the present invention hooks the mating connector 200 via the hooks 382 of the hooking plate 38, which is very stable and is not easily apart in accident.

3. The plug connector 100 of the present invention is simply to take apart. The user just only press the handle portion 34 of the disengaged member 30, and then the plug connector 100 can be pulled from the mating connector 200.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A plug connector, plugging with a mating connector, said plug connector comprising:

a lower housing;

a upper housing, being fixed on said lower housing, said upper housing having a receiving cavity concaved from a top surface thereof and a pivotal groove formed in said receiving cavity;

a disengaged member, including a main body formed with a rod-shaped portion rotatably disposed in said pivotal groove, an elastic member disposed on said main body, a handle portion extending upwardly from said main body in an inclined way, and a hooking plate extending from said main body opposite said handle portion, said hooking plate being exposed outside said upper housing to hook a top surface of said mating connector; and a covering lid, fixed on said upper housing and covering said receiving cavity, wherein said elastic member props against a bottom surface of said covering lid.

2. The plug connector as claimed in claim 1, wherein said upper housing has a pair of positioning boards protruding therefrom and disposed in said receiving cavity, and said main body of said disengaged member is disposed between said pair of positioning boards.

3. The plug connector as claimed in claim 1, wherein said elastic member is formed integrally on said main body.

4. The plug connector as claimed in claim 1, wherein said bottom surface of said covering lid presses on said rod-shaped portion of said disengaged member.

5. The plug connector as claimed in claim 1, wherein said mating connector forms a pair of engaging notches on a top surface thereof, and wherein said hooking plate of said disengaged member is protruded downwardly with a pair of hooks at an end thereof corresponding to said pair of engaging notches.

6. The plug connector as claimed in claim 1, wherein said upper housing forms an erect opening communicating with said receiving cavity, and wherein said hooking plate of said disengaged member is movably disposed in said erect opening.

7. The plug connector as claimed in claim 1, further comprising a washer elastically contacted with said mating connector and pushing said mating connector to engage with said hooking plate.

8. The plug connector as claimed in claim 1, wherein said disengaged member is a metal board, and wherein said rod-shaped portion is a cylinder-shaped shell by punching said main body.

9. The plug connector as claimed in claim 8, wherein said rod-shaped portion includes a pair of lower-curve plates, and an upper-curve plate located between said pair of lower-curve plates.

10. The plug connector as claimed in claim 9, wherein said elastic member extends upwardly from one end of said upper-curve plate.

* * * * *